US012246208B2

(12) United States Patent
McCoy et al.

(10) Patent No.: US 12,246,208 B2
(45) Date of Patent: Mar. 11, 2025

(54) FASTENING DEVICE FOR SPORTS EQUIPMENT

(71) Applicant: Klink Fitness Limited, County Armagh (GB)

(72) Inventors: Nikita McCoy, County Armagh (GB); Graeme McCoy, County Armagh (GB); Gary Magowan, County Tyrone (GB)

(73) Assignee: Klink Fitness Limited, County Armagh (GB)

( * ) Notice: Subject to any disclaimer, the term of this patent is extended or adjusted under 35 U.S.C. 154(b) by 183 days.

(21) Appl. No.: 18/247,744

(22) PCT Filed: Oct. 4, 2021

(86) PCT No.: PCT/EP2021/077317
§ 371 (c)(1),
(2) Date: Apr. 3, 2023

(87) PCT Pub. No.: WO2022/073942
PCT Pub. Date: Apr. 14, 2022

(65) Prior Publication Data

US 2023/0256288 A1 Aug. 17, 2023

(30) Foreign Application Priority Data

Oct. 5, 2020 (GB) ..... 2015739

(51) Int. Cl.
*A63B 21/072* (2006.01)
*A63B 21/075* (2006.01)

(52) U.S. Cl.
CPC ..... *A63B 21/0728* (2013.01); *A63B 21/0726* (2013.01); *A63B 21/075* (2013.01)

(58) Field of Classification Search
CPC ..... A63B 21/00065; A63B 21/072; A63B 21/0726; A63B 21/0728; A63B 21/075
See application file for complete search history.

(56) References Cited

U.S. PATENT DOCUMENTS 5,407,413 A 4/1995 Kupferman
7,037,245 B2 * 5/2006 Burwell ..... A63B 21/075 482/106

(Continued)

*Primary Examiner* — Joshua Lee
(74) *Attorney, Agent, or Firm* — LaMorte & Assocals PC

(57) ABSTRACT

A fastening device for sports equipment comprising a first weight plate and a second weight plate, the fastening device comprising: a first fastening mechanism provided on a face of the first weight plate comprising: an annular groove formed by a radial inner wall and a radial outer wall depending inwardly from and axially aligned with the face of the first weight plate, a plurality of circular cavities formed by a radial inward and a radial outward extension of the inner wall and the outer wall of the groove, the cavities located at a plurality of substantially evenly-spaced locations around the groove, a plurality of curved guides formed by radial recesses within the inner wall and the outer wall of the groove, each guide starting at a cavity and extending an equal length along the groove in a first direction and having a width substantially equal to a diameter of the cavity, and a notch formed by walls extending radially from an outer edge of the first weight plate to the annular groove and located at a circumferential notch position, a second fastening mechanism provided on a face of the second weight plate comprising: an annular ridge formed by a radial inner wall and a radial outer wall depending outwardly from and axially aligned with the face of the second weight plate, a plurality of circular cavities formed by a radial inward and a radial outward extension of the inner wall and the outer wall of the ridge, each located at a plurality of substantially evenly-spaced locations around the ridge, a plurality of rollers each located within one of the cavities and having a width less than a diameter of the cavity, a flexible clip located in a recess provided in the second weight plate at a circumferential clip position offset from the circumferential notch position by the length of the guides, the clip comprising a first portion received and attached within a first recess (Continued)

part in the face of the second weight plate extending radially from an outer edge of the second weight plate through the ridge and having a protrusion extending radially from the outer edge of the second weight plate towards the ridge and a second portion received within a second recess part extending axially from the outer edge and across a side wall of the second weight plate which second portion can be flexed to axially retract the protrusion.

18 Claims, 8 Drawing Sheets

(56) References Cited

U.S. PATENT DOCUMENTS

| | | | | |
|---|---|---|---|---|
| 7,491,157 | B1 * | 2/2009 | Lin | A63B 21/072 482/107 |
| 8,790,223 | B2 * | 7/2014 | Wang | A63B 21/075 482/106 |
| 8,900,104 | B2 * | 12/2014 | Shozda | A63B 21/0728 482/106 |
| 10,420,978 | B2 * | 9/2019 | Wang | A63B 21/072 |
| 10,583,318 | B2 * | 3/2020 | Nalley | A63B 21/0726 |
| 2003/0096683 | A1 | 5/2003 | Fenelon et al. | |
| 2004/0067826 | A1 * | 4/2004 | Elledge | A63B 21/075 482/141 |
| 2013/0231225 | A1 * | 9/2013 | Shozda | A63B 21/075 482/108 |
| 2017/0259107 | A1 | 9/2017 | Shalvi et al. | |
| 2023/0173326 | A1 * | 6/2023 | Yao | A63B 21/0728 482/107 |

* cited by examiner

FASTENING DEVICE FOR SPORTS EQUIPMENT

The invention relates to a fastening device for sports equipment, particularly dumbbells to which multiple different weight plates can be attached.

BACKGROUND TO THE INVENTION

Use of dumbbells in exercise regimes is common and often different weight dumbbells are required in a regime. Multiple dumbbells having different weights or a dumbbell with multiple attachments having different weights can be used. In either case, there can be issues with, for example, storage or with changing attachments to achieve a specific dumbbell weight. It is an object of the present invention to alleviate the problems encountered with traditional dumbbells.

SUMMARY OF THE INVENTION

According to a first aspect of the invention there is provided a fastening device for sports equipment comprising a first weight plate and a second weight plate, the fastening device comprising:

a first fastening mechanism provided on a face of the first weight plate comprising:

an annular groove formed by a radial inner wall and a radial outer wall depending inwardly from and axially aligned with the face of the first weight plate, a plurality of circular cavities formed by a radial inward and a radial outward extension of the inner wall and the outer wall of the groove, the cavities located at a plurality of substantially evenly-spaced locations around the groove, a plurality of curved guides formed by radial recesses within the inner wall and the outer wall of the groove, each guide starting at a cavity and extending an equal length along the groove in a first direction and having a width substantially equal to a diameter of the cavity, and a notch formed by walls extending radially from an outer edge of the first weight plate to the annular groove and located at a circumferential notch position, a second fastening mechanism provided on a face of the second weight plate comprising:

an annular ridge formed by a radial inner wall and a radial outer wall depending outwardly from and axially aligned with the face of the second weight plate, a plurality of circular cavities formed by a radial inward and a radial outward extension of the inner wall and the outer wall of the ridge, each located at a plurality of substantially evenly-spaced locations around the ridge, a plurality of rollers each located within one of the cavities and having a width less than a diameter of the cavity, a flexible clip located in a recess provided in the second weight plate at a circumferential clip position offset from the circumferential notch position by the length of the guides, the clip comprising a first portion received and attached within a first recess part in the face of the second weight plate extending radially from an outer edge of the second weight plate through the ridge and having a protrusion extending radially from the outer edge of the second weight plate towards the ridge and a second portion received within a second recess part extending axially from the outer edge and across a side wall of the second weight plate which second portion can be flexed to axially retract the protrusion.

The first weight plate may comprise a fixed weight plate attached to a handle of a dumbbell. The first weight plate may comprise a fixed weight plate attached to a bar of a weightlifting bar.

According to a second aspect of the invention there is provided a dumbbell comprising a fastening device according to the first aspect of the invention, the dumbbell comprising:

a base unit having a handle, first and second fixed weight plates fixedly attached to first and second ends of the handle, each fixed weight plate comprising an outer face located away from the handle which provides a first fastening mechanism of the fastening device comprising:

an annular groove formed by a radial inner wall and a radial outer wall depending inwardly from and axially aligned with the outer face of the plate, a plurality of circular cavities formed by a radial inward and a radial outward extension of the inner wall and the outer wall of the groove, the cavities located at a plurality of substantially evenly-spaced locations around the groove, a plurality of curved guides formed by radial recesses within the inner wall and the outer wall of the groove, each guide starting at a cavity and extending an equal length along the groove in a first direction and having a width substantially equal to a diameter of the cavity, and a notch formed by walls extending radially from an outer edge of the plate to the annular groove and located at a circumferential notch position, first and second weight plates, each comprising an inner face which provides a second fastening mechanism of the fastening device comprising:

an annular ridge formed by a radial inner wall and a radial outer wall depending outwardly from and axially aligned with the inner face of the plate, a plurality of circular cavities formed by a radial inward and a radial outward extension of the inner wall and the outer wall of the ridge, each located at a plurality of substantially evenly-spaced locations around the ridge, a plurality of rollers each located within one of the cavities and having a width less than a diameter of the cavity, a flexible clip located in a recess provided in the plate at a circumferential clip position offset from the circumferential notch position by the length of the guides, the clip comprising a first portion received and attached within a first recess part in the inner face of the plate extending radially from an outer edge of the plate through the ridge and having a protrusion extending radially from the outer edge of the plate towards the ridge and a second portion received within a second recess part extending axially from the outer edge and across a side wall of the plate which second portion can be flexed to axially retract the protrusion.

The second fastening mechanism of a weight plate may attach to the first fastening mechanism of a fixed weight plate by aligning the annular ridge and the circular cavities and rollers of the second fastening mechanism of the weight plate with the annular groove and the circular cavities of the first fastening mechanism of the fixed weight plate, inserting the annular ridge and the rollers into the annular groove and circular cavities, and rotating the weight plate to move the rollers along the guides of the first fastening mechanism of the fixed weight plate and to locate the protrusion of the clip of the second fastening mechanism of the weight plate in the notch of the first fastening mechanism of the fixed weight plate.

The second fastening mechanism of a weight plate may detach from the first fastening mechanism of a fixed weight plate by axially moving the second portion of the flexible clip of the second fastening mechanism of the weight plate to release the protrusion of the clip from the notch of the first fastening mechanism of the fixed weight plate, rotating the weight plate to move the rollers of the second fastening mechanism of the weight plate back along the guides of the first fastening mechanism of the fixed weight plate and removing the annular ridge and the rollers from the annular groove and circular cavities.

Inadvertent detachment of the weight plate from the fixed weight plate is prevented by the protrusion and notch which restrict movement of the weight plate in a circumferential direction and the rollers and guides which restrict movement of the weight plate in an axial direction.

The first and second weight plates may each comprise an outer face which provides a first fastening mechanism of further fastening devices comprising:

- an annular groove formed by a radial inner wall and a radial outer wall depending inwardly from and axially aligned with the outer face of the plate,
- a plurality of circular cavities formed by a radial inward and a radial outward extension of the inner wall and the outer wall of the groove, the cavities located at a plurality of substantially evenly-spaced locations around the groove,
- a plurality of curved guides formed by radial recesses within the inner wall and the outer wall of the groove, each guide starting at a cavity and extending an equal length along the groove in a first direction and having a width substantially equal to a diameter of the cavity, and
- a notch formed by walls extending radially from an outer edge of the plate to the annular groove and located at a circumferential notch position.

The dumbbell may comprise second and third weight plates, each comprising an inner face which provides a second fastening mechanism of the further fastening devices comprising:

- an annular ridge formed by a radial inner wall and a radial outer wall depending outwardly from and axially aligned with the inner face of the plate,
- a plurality of circular cavities formed by a radial inward and a radial outward extension of the inner wall and the outer wall of the ridge, each located at a plurality of substantially evenly-spaced locations around the ridge,
- a plurality of rollers each located within one of the cavities and having a width less than a diameter of the cavity,
- a flexible clip located in a recess provided in the plate at a circumferential clip position offset from the circumferential notch position by the length of the guides, the clip comprising a first portion received and attached within a first recess part in the inner face of the plate extending radially from an outer edge of the plate through the ridge and having a protrusion extending radially from the outer edge of the plate towards the ridge and a second portion received within a second recess part extending axially from the outer edge and across a side wall of the plate which second portion can be flexed to axially retract the protrusion.

The second fastening mechanism of a third or fourth weight plate may attach to the first fastening mechanism of a first or second weight plate by aligning the annular ridge and the circular cavities and rollers of the second fastening mechanism of the third or fourth weight plate with the annular groove and circular cavities of the first fastening mechanism of the first or second weight plate, inserting the annular ridge and the rollers into the annular groove and circular cavities, and rotating the third or fourth weight plate to move the rollers along the guides of the first fastening mechanism of the first or second weight plate and to locate the protrusion of the clip of the second fastening mechanism of the third or fourth weight plate in the notch of the first fastening mechanism of the first or second weight plate.

The second fastening mechanism of a third or fourth weight plate may detach from the first fastening mechanism of a first or second weight plate by axially moving the second portion of the flexible clip of the second fastening mechanism of the third or fourth weight plate to release the protrusion of the clip from the notch of the first fastening mechanism of the first or second weight plate, rotating the third or fourth weight plate to move the rollers of the second fastening mechanism of the third or fourth weight plate back along the guides of the first fastening mechanism of the first or second weight plate and removing the annular ridge and the rollers from the annular groove and circular cavities.

The first and second fixed weight plates may be fixedly attached to first and second ends of the handle of the base unit by a shrinkage fit process. The first and second fixed weight plates may be fixedly attached to first and second ends of the handle of the base unit such that the notch positions of the fixed weight plates are substantially circumferentially aligned.

The plurality of curved guides may extend along the groove in a clockwise direction. The plurality of curved guides may extend along the groove in an anticlockwise direction.

The dumbbell may comprise first and second cover plates. The cover plates may be attached to the first and second fixed weight plates. The cover plates may be attached to the first and second weight plates. The cover plates may be attached to the third and fourth weight plates. The cover plates may each comprise an outer face having a recess in the shape of a conical frustum.

The base unit may comprise a specified weight comprising any of 1 kg, 2 kg. The first and second weight plates may each comprise a specified weight comprising any of 1 kg, 2 kg, 3 kg, 4 kg. The first and second weight plates may each comprise a specified weight comprising any of 1 kg, 2 kg, 3 kg, 4 kg. The first and second cover plates may each comprise a specified weight comprising any of 1 kg, 2 kg, 3 kg, 4 kg.

BRIEF DESCRIPTION OF THE DRAWINGS

Two embodiments of the invention will now be described, by way of example only, with reference to the accompanying drawings, in which.

DETAILED DESCRIPTION

Figure 1:
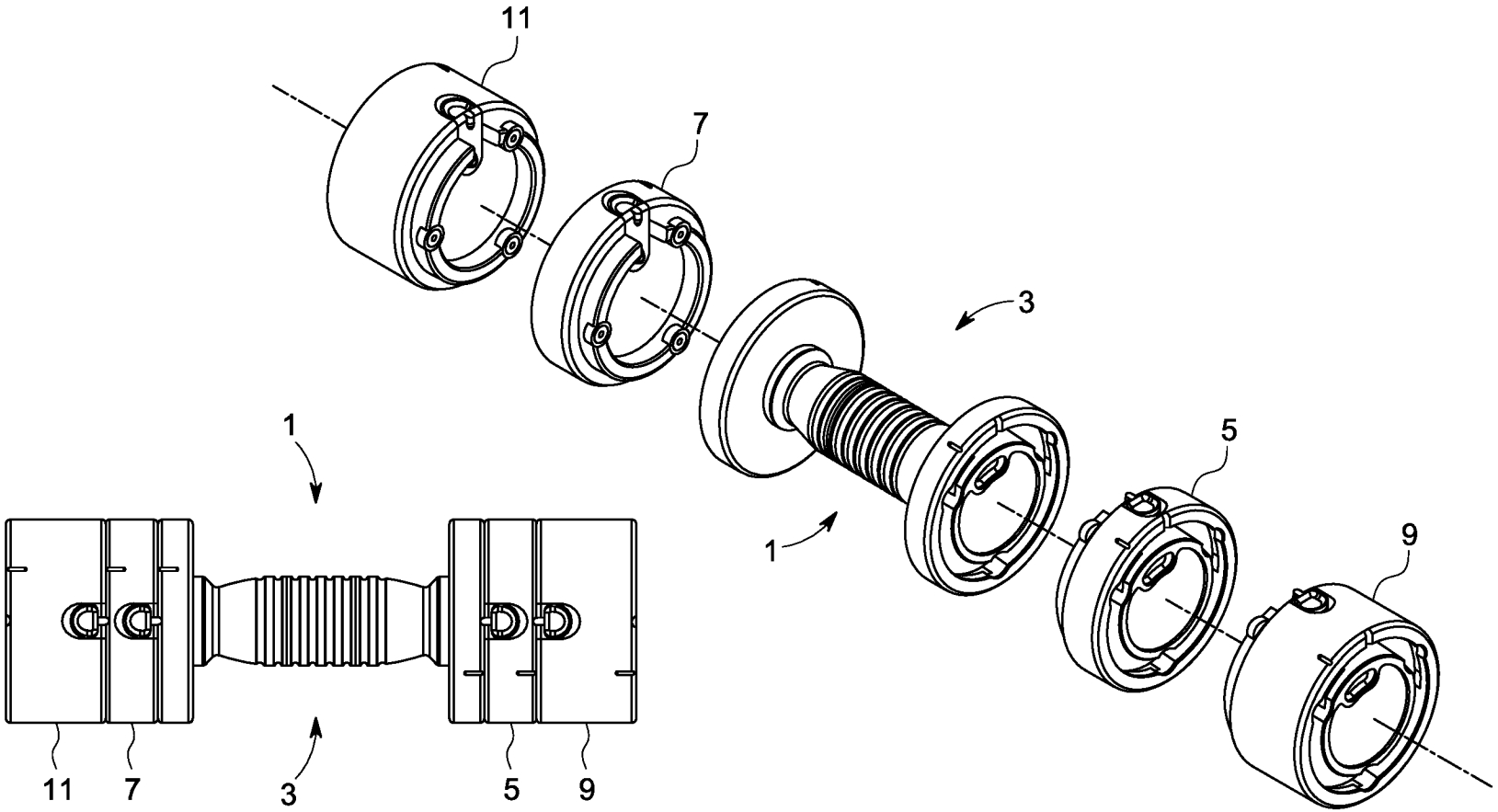
FIG. 1 shows schematic representations of the first embodiment of a dumbbell according to the second aspect of the invention comprising a fastening device according to the first aspect of the invention.

Referring to the first embodiment and initially to FIG. 1, a dumbbell 1 comprises a base unit 3 having a weight of 2 kg, first and second weight plates 5, 7 each having a weight of 1 kg and third and fourth weight plates 9, 11 each having a weight of 2 kg. The first and second weight plates 5, 7 are attached to the base unit 3 and the third and fourth weight plates 9, 11 are attached to the first and second weight plates 5, 7. It will be appreciated that the dumbbell could comprise only the first and second weight plates with the base unit or only the third and fourth weight plates with the base unit. The dumbbell of the invention comprises a fully modular system and different weight plates can be added to the base unit in any order to achieve a desired weight of the dumbbell for a user.

Figure 2:
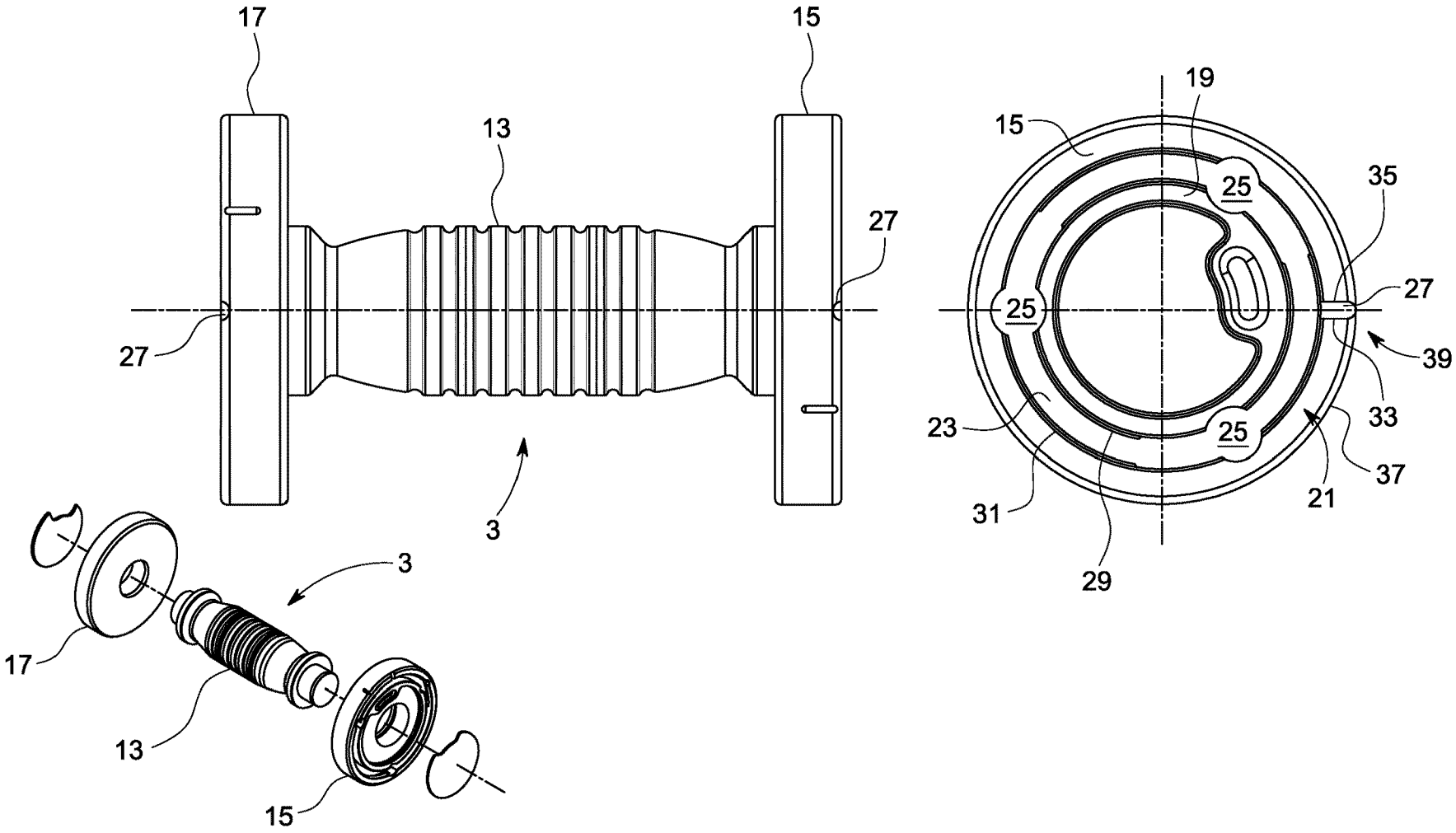
FIG. 2 shows schematic representations of a base unit of the dumbbell of FIG. 1.

Referring to FIG. 2, the base unit 3 has a handle 13, a first fixed weight plate 15 and a second fixed weight plate 17. The fixed weight plates 15, 17 are fixedly attached to first and second ends of the handle 13 by a shrinkage fit process.

The outer face 19 of the first fixed weight plate 15 provides a first fastening mechanism 21 of a fastening device. This comprises an annular groove 23, a plurality of circular cavities 25, a plurality of curved guides (not shown) and a notch 27. The annular groove 23 is formed by a radial inner wall 29 and a radial outer wall 31 depending inwardly from and axially aligned with the outer face 19 of the plate 15. The plurality of circular cavities 25 are formed by a radial inward and a radial outward extension of the inner wall 29 and the outer wall 31 of the groove 23. The cavities are located at three substantially evenly-spaced locations around the groove 23. The plurality of curved guides are formed by radial recesses within the inner wall 29 and the outer wall 31 of the groove 23. Each guide starts at a cavity 25 and extends an equal length along the groove in a clockwise direction and has a width substantially equal to a diameter of the cavity 25. The notch 27 is formed by walls 33, 35 extending radially from an outer edge 37 of the plate 15 to the annular groove 23 and located at a circumferential notch position 39. The first and second fixed weight plates 15, 17 are attached to the handle 13 such that the notch positions 39 are circumferentially aligned.

Figure 3:
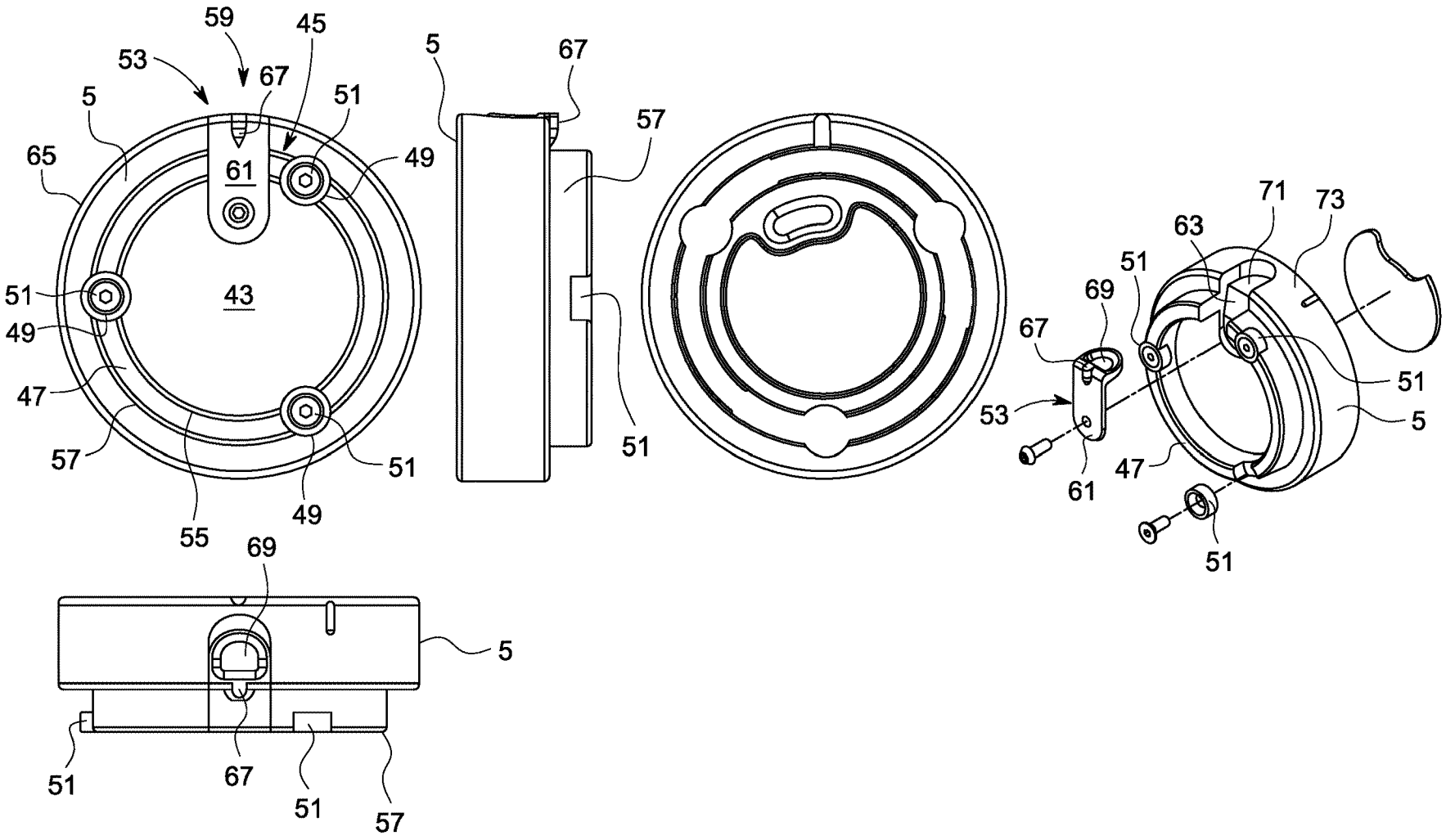
FIG. 3 shows schematic representations of a first or second weight plate of the dumbbell of FIG. 1.

Referring to FIG. 3, the first weight plate 5 comprises an inner face 43 which provides a second fastening mechanism 45 of the fastening device. This comprises an annular ridge 47, a plurality of circular cavities 49, a plurality of rollers 51 and a flexible clip 53.

The annular ridge 47 is formed by a radial inner wall 55 and a radial outer wall 57 depending outwardly from and axially aligned with the inner face 43 of the plate 5. The plurality of circular cavities 49 are formed by a radial inward and a radial outward extension of the inner wall 55 and the outer wall 57 of the ridge 47. Each cavity is located at three substantially evenly-spaced locations around the ridge 47. The plurality of rollers 51 are each located within one of the cavities 49 and have a width less than a diameter of the cavity 49. The flexible clip 53 is located in a recess provided in the plate 5 at a circumferential clip position 59. The circumferential clip position 59 is offset from the circumferential notch position 39 by the length of the guides of the fastening mechanism 21 of the fixed weight plate 15. The clip 53 comprises a first portion 61 received and attached within a first recess part 63 in the inner face 43 of the plate 5 extending radially from an outer edge 65 of the plate 5 through the annular ridge 47. The first portion 61 of the clip 53 is attached within the first recess part 63 in the inner face 43 of the plate 5 by a button head screw, which is received in a recess of the face 19 of the fixed weight plate 15. The first portion 61 of the clip 53 has a protrusion 67 extending radially from the outer edge 65 of the plate 5 towards the ridge 47. The clip 53 comprises a second portion 69 received within a second recess part 71 extending axially from the outer edge 65 and across a side wall 73 of the plate 5. The second portion 69 of the clip 53 can be flexed to axially retract the protrusion 67.

The second fastening mechanism 45 of the first weight plate 5 attaches to the first fastening mechanism 21 of the first fixed weight plate 15 by aligning the annular ridge 47 and the circular cavities 49 and rollers 51 of the second fastening mechanism 45 of the first weight plate 5 with the annular groove 23 and circular cavities 25 of the first fastening mechanism 21 of the first fixed weight plate 15, inserting the annular ridge 47 and the rollers 51 into the annular groove 23 and circular cavities 25, and rotating the first weight plate 5 to move the rollers 51 along the guides of the first fastening mechanism 21 of the first fixed weight plate 15 and to locate the protrusion 67 of the clip 63 of the second fastening mechanism 45 of the first weight plate 5 in the notch 27 of the first fastening mechanism 21 of the first fixed weight plate 15.

The second fastening mechanism 45 of the first weight plate 5 detaches from the first fastening mechanism 21 of the first fixed weight plate 15 by axially flexing the second portion 69 of the flexible clip 53 of the second fastening mechanism 45 of the first weight plate 5 to retract the protrusion 67 of the clip 53 from the notch 27 of the first fastening mechanism 21 of the first fixed weight plate 15, rotating the first weight plate 5 to move the rollers 51 of the second fastening mechanism 45 of the first weight plate 5 back along the guides of the first fastening mechanism 21 of the first fixed weight plate 15 and removing the annular ridge 47 and the rollers 51 from the annular groove 23 and circular cavities 25.

The first weight plate 5 of the dumbbell 1 comprises an outer face which provides a first fastening mechanism of a second fastening device similar to the first fastening mechanism 21 of the outer face 19 of the first fixed weight plate 15. The first fastening mechanism of the outer face of the first weight plate 5 comprises an annular groove, a plurality of circular cavities, a plurality of curved guides and a notch, as described with reference to the first fastening mechanism 21 of the outer face 19 of the first fixed weight plate 15.

Figure 4:
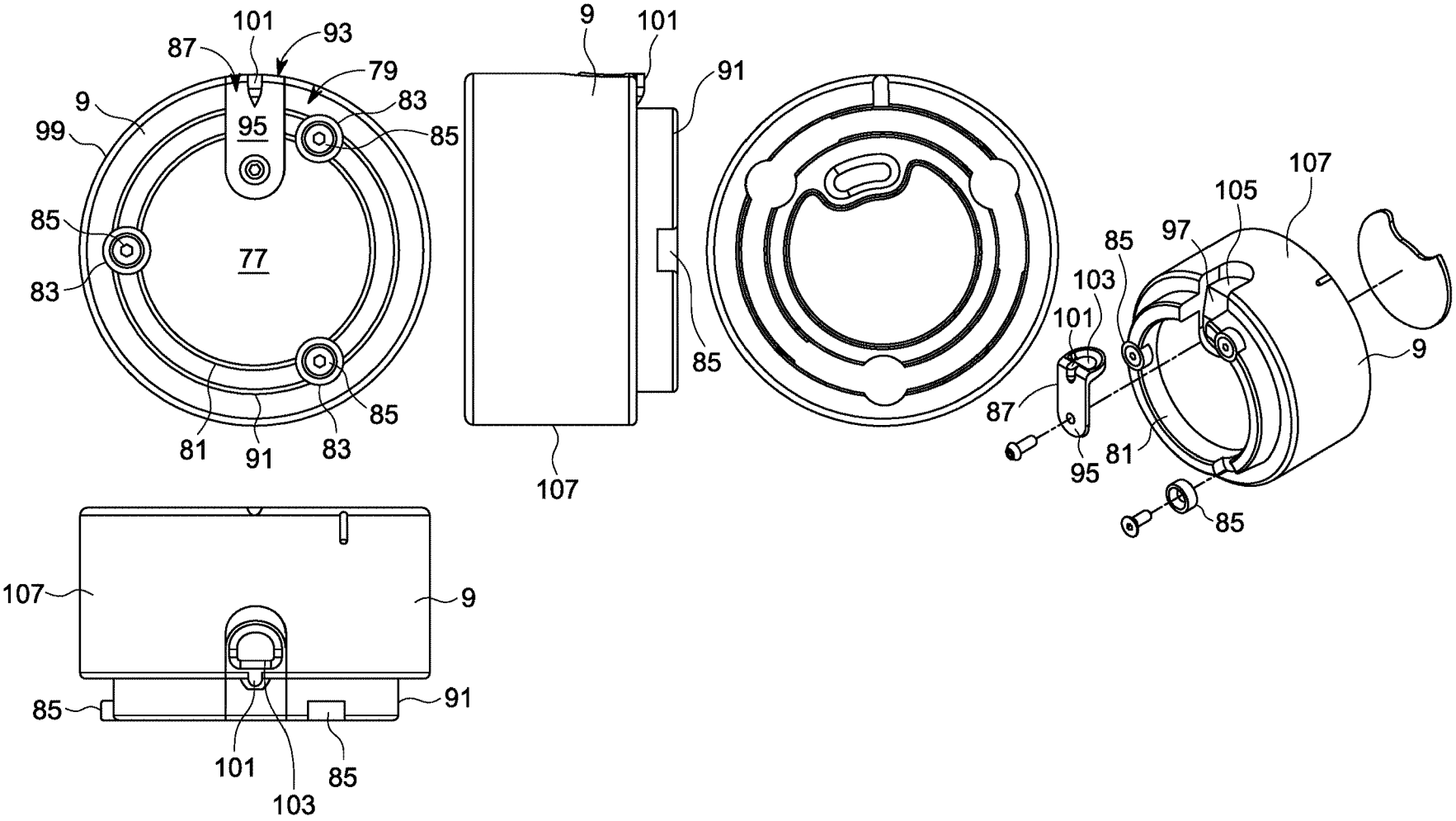
FIG. 4 shows schematic representations of a third or fourth weight plate of the dumbbell of FIG. 1.
Figure 5:
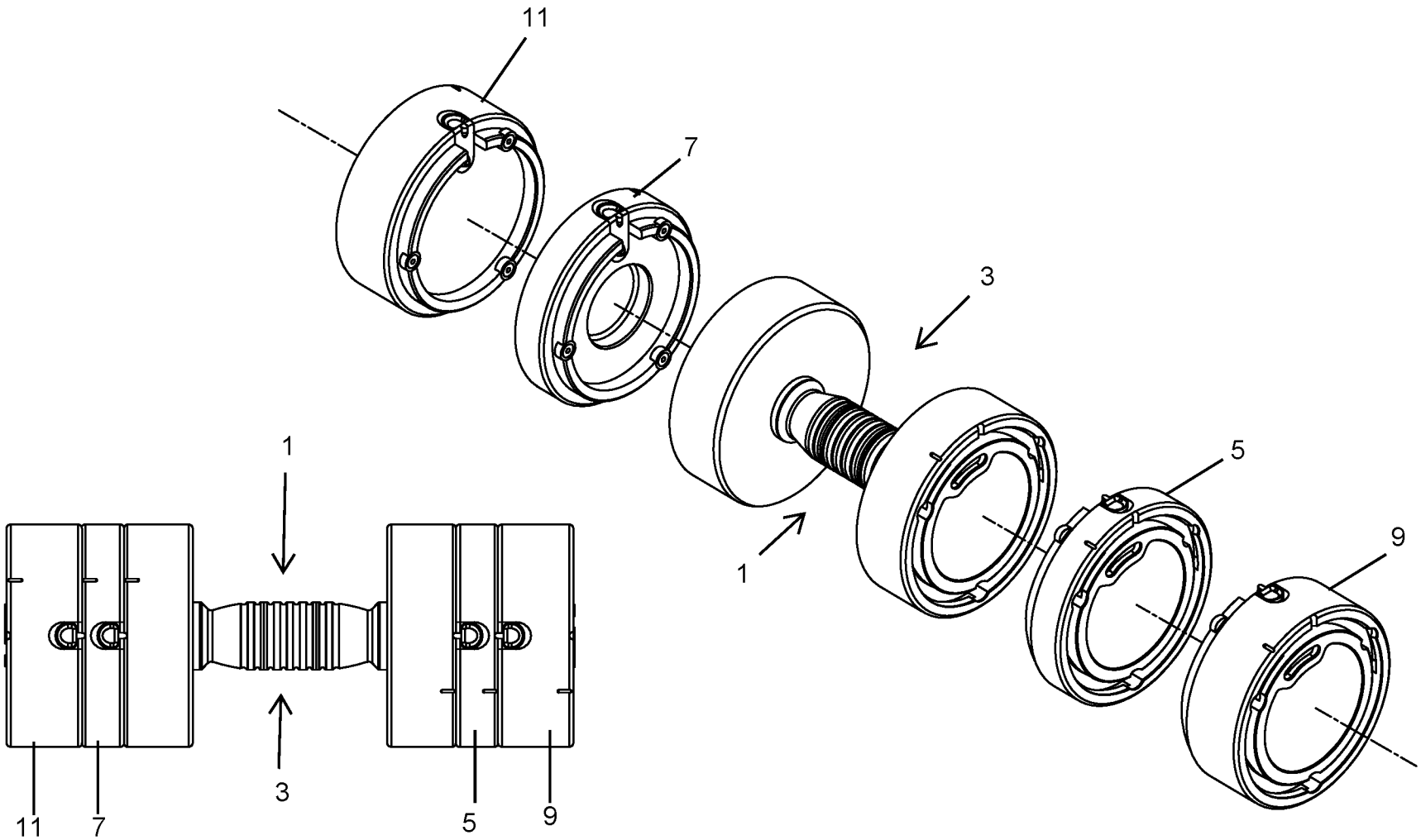
FIG. 5 shows schematic representations of the second embodiment of a dumbbell according to the second aspect of the invention comprising a fastening device according to the first aspect of the invention.
Figure 6:
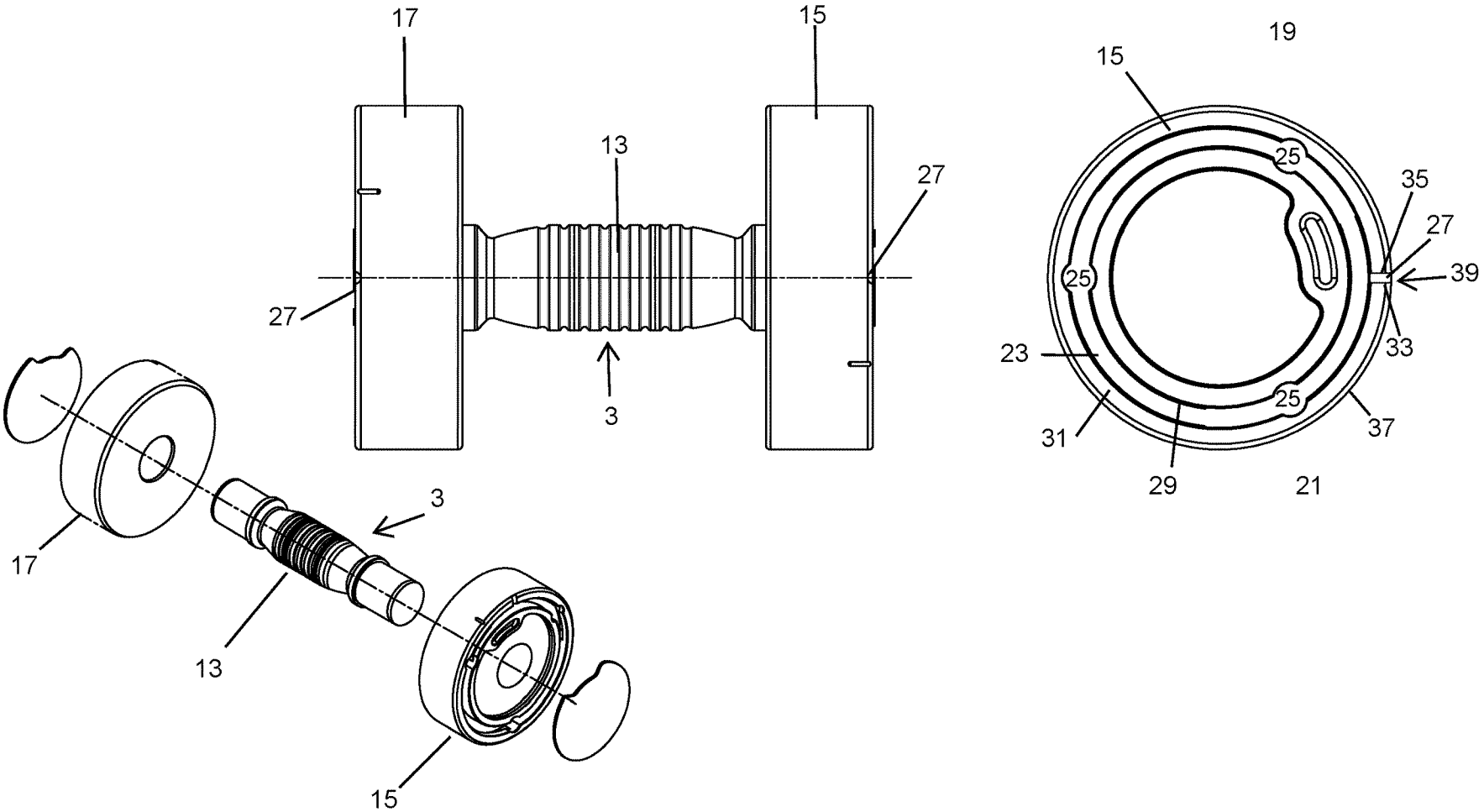
FIG. 6 shows schematic representations of a base unit of the dumbbell of FIG. 5.
Figure 7:
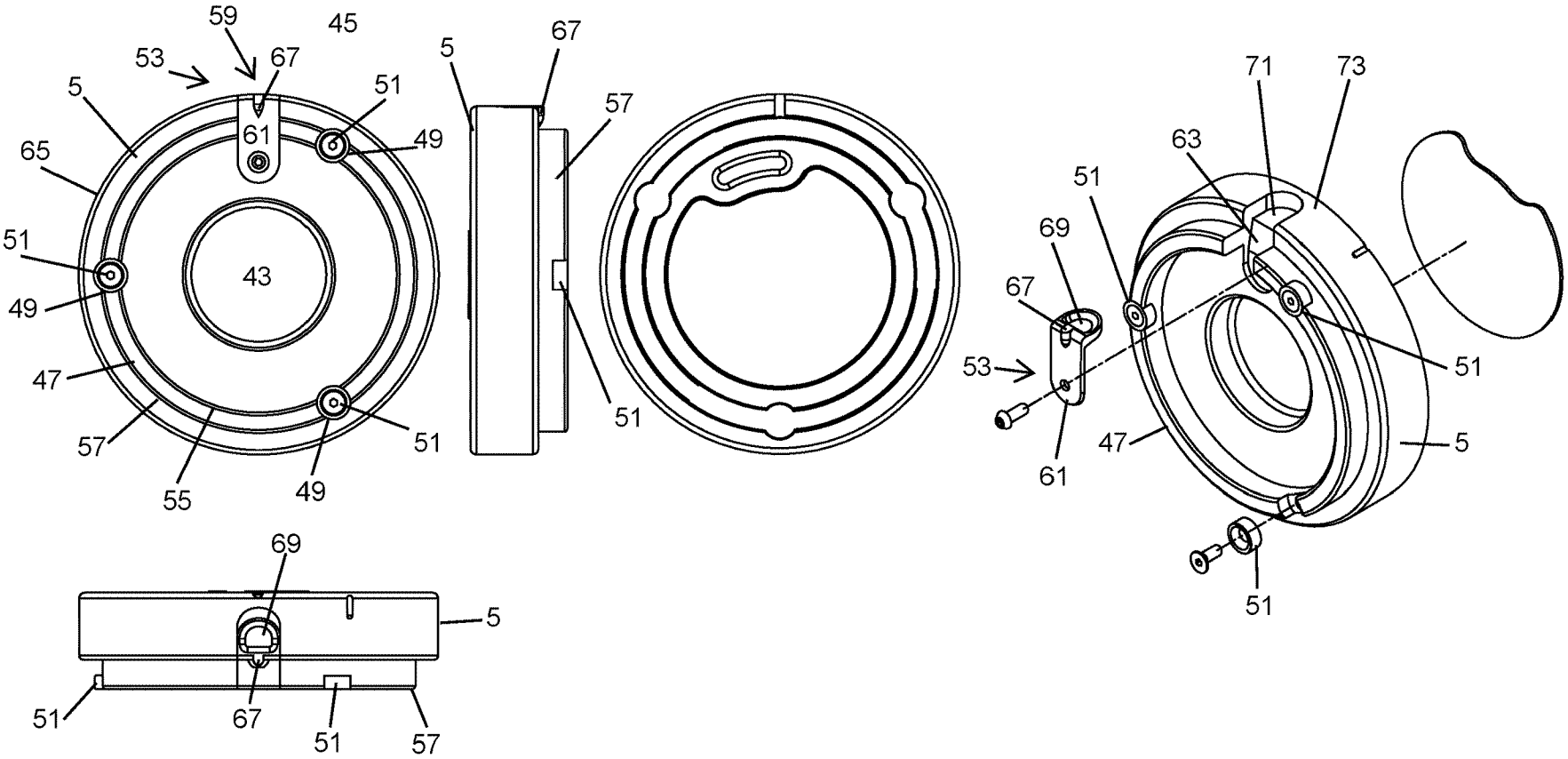
FIG. 7 shows schematic representations of a first or second weight plate of the dumbbell of FIG. 5.
Figure 8:
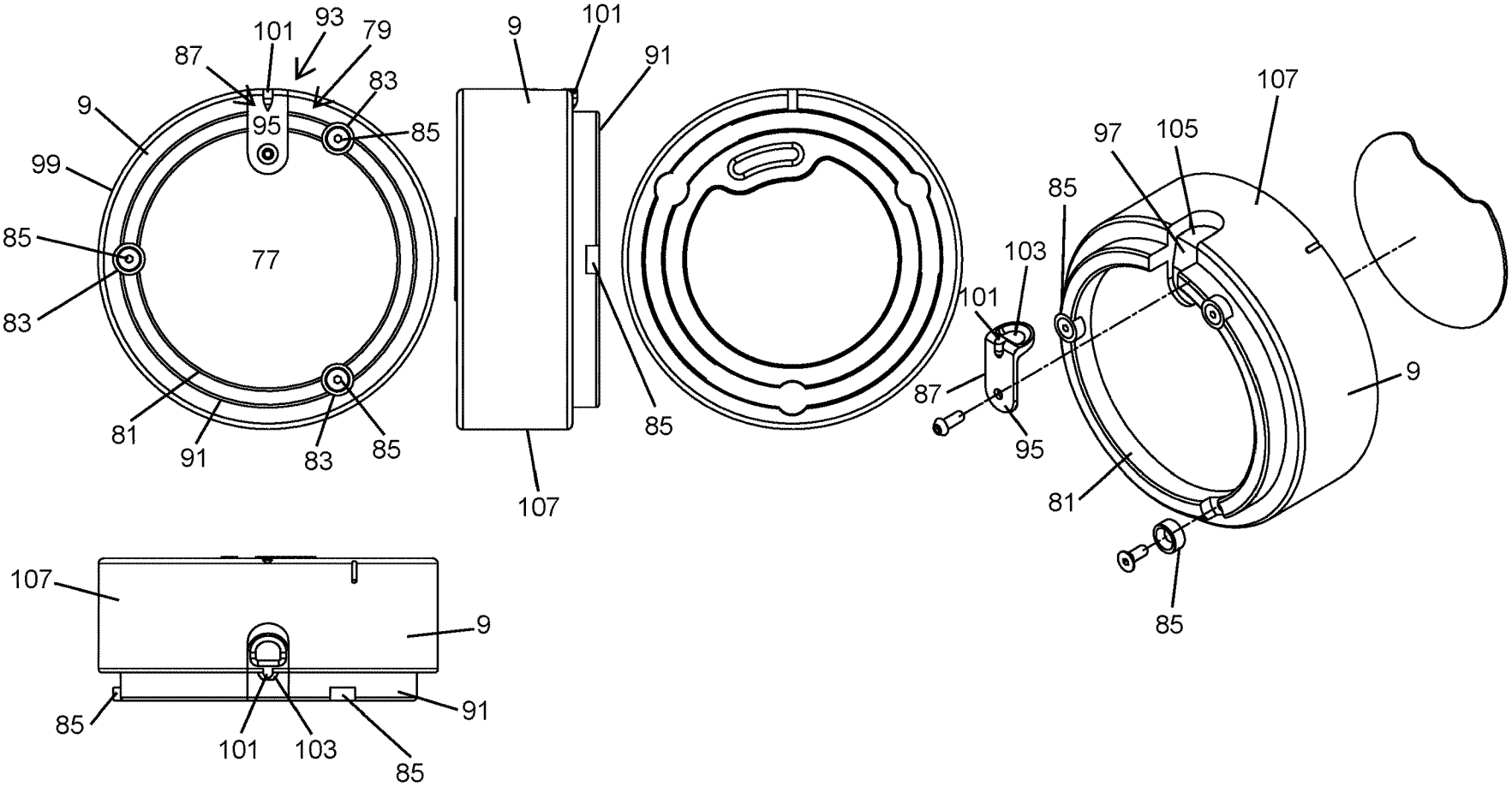
FIG. 8 shows schematic representations of a third or fourth weight plate of the dumbbell of FIG. 5.

Referring to FIG. 4, the third weight plate 9 comprises an inner face 77 which provides a second fastening mechanism 79 of the second fastening device. This comprises an annular ridge 81, a plurality of circular cavities 83, a plurality of rollers 85 and a flexible clip 87.

The annular ridge 81 is formed by a radial inner wall 89 and a radial outer wall 91 depending outwardly from and axially aligned with the inner face 77 of the plate 9. The plurality of circular cavities 83 are formed by a radial inward and a radial outward extension of the inner wall 89 and the outer wall 91 of the ridge 81. Each cavity is located at three substantially evenly-spaced locations around the ridge 81. The plurality of rollers 85 are each located within one of the cavities 83 and have a width less than a diameter of the cavity 83. The flexible clip 87 is located in a recess provided in the plate 9 at a circumferential clip position 93. The circumferential clip position 93 is offset from the circumferential notch position by the length of the guides of the fastening mechanism of the first weight plate 5. The clip 87 comprises a first portion 95 received and attached within a first recess part 97 in the inner face 77 of the plate 9 extending radially from an outer edge 99 of the plate 9 through the annular ridge 81. The first portion 95 of the clip 87 is attached within the first recess part 97 in the inner face 77 of the plate 9 by a button head screw, which is received in a recess of the outer face of the weight plate 5. The first portion 95 of the clip 87 has a protrusion 101 extending radially from the outer edge 99 of the plate 9 towards the ridge 81. The clip 87 comprises a second portion 103 received within a second recess part 105 extending axially from the outer edge 99 and across a side wall 107 of the plate 9. The second portion 103 of the clip 87 can be flexed to axially retract the protrusion 101.

The second fastening mechanism 79 of the inner face 77 of the third weight plate 9 attaches to the first fastening mechanism of the outer face of the first weight plate 5 by aligning the annular ridge 81 and the circular cavities 83 and rollers 85 of the second fastening mechanism 79 of the third weight plate 9 with the annular groove and circular cavities of the first fastening mechanism of the first weight plate 5, inserting the annular ridge 81 and the rollers 85 into the annular groove and circular cavities, and rotating the third weight plate 9 to move the rollers 85 along the guides of the first fastening mechanism of the first weight plate 5 and to locate the protrusion 101 of the clip 87 of the second fastening mechanism 79 of the third weight plate 9 in the notch of the first fastening mechanism of the first weight plate 5.

The second fastening mechanism 79 of the third weight plate 9 detaches from the first fastening mechanism of the outer face of the first weight plate 5 by axially flexing the second portion 103 of the flexible clip 87 of the second fastening mechanism 79 of the third weight plate 9 to retract the protrusion 101 of the clip 87 from the notch of the first fastening mechanism of the first weight plate 5, rotating the third weight plate 9 to move the rollers 85 of the second fastening mechanism 79 of the third weight plate 9 back along the guides of the first fastening mechanism of the first weight plate 5 and removing the annular ridge 81 and the rollers 85 from the annular groove and circular cavities of the fastening mechanism of the outer face of the first weight plate 5.

Referring to FIG. 1, the third weight plate 9 of the dumbbell 1 comprises an outer face which provides a first fastening mechanism of a fastening device similar to the first fastening mechanism 21 of the outer face 19 of the first fixed weight plate 15. The first fastening mechanism of the outer face of the third weight plate 9 comprises an annular groove, a plurality of circular cavities, a plurality of curved guides and a notch, as described with reference to the first fastening mechanism 21 of the outer face 19 of the first fixed weight plate 15. The first fastening mechanism of the outer face of the third weight plate 9 may be attached to a second fastening mechanism of the fastening device of an inner face of a fifth weight plate or to a second fastening mechanism of the fastening device of an inner face of a cover plate.

Referring to FIG. 1, the outer face (not shown) of the second fixed weight plate 17 of the base unit 3 provides a first fastening mechanism of a third fastening device similar to the first fastening mechanism 21 of the outer face 19 of the first fixed weight plate 15. The first fastening mechanism of the outer face of the second fixed weight plate 17 comprises an annular groove, a plurality of circular cavities, a plurality of curved guides and a notch, as described with reference to the first fastening mechanism 21 of the outer face 19 of the first fixed weight plate 15.

The second weight plate 7 comprises an inner face which provides a second fastening mechanism of the third fastening device similar to the second fastening mechanism 45 of the inner face 43 of the first weight plate 5. This comprises an annular ridge, a plurality of circular cavities, a plurality of rollers and a flexible clip, as described with reference to the second fastening mechanism 45 of the inner face 43 of the first weight plate 5.

The second fastening mechanism of the second weight plate 7 attaches to the first fastening mechanism of the second fixed weight plate 17 by aligning the annular ridge and the circular cavities and rollers of the second fastening mechanism of the second weight plate 7 with the annular groove and circular cavities of the first fastening mechanism of the second fixed weight plate 17, inserting the annular ridge and the rollers into the annular groove and circular cavities, and rotating the second weight plate 7 to move the rollers along the guides of the first fastening mechanism of the second fixed weight plate 17 and to locate the protrusion of the clip of the second fastening mechanism of the second weight plate 7 in the notch of the first fastening mechanism of the second fixed weight plate 17.

The second fastening mechanism of the second weight plate 7 detaches from the first fastening mechanism of the second fixed weight plate 17 by axially flexing the second portion of the flexible clip of the second fastening mechanism of the second weight plate 7 to retract the protrusion of the clip from the notch of the first fastening mechanism of the second fixed weight plate 17, rotating the second weight plate 7 to move the rollers of the second fastening mechanism of the second weight plate 7 back along the guides of the first fastening mechanism of the second fixed weight plate 17 and removing the annular ridge and the rollers from the annular groove and circular cavities.

Referring to FIG. 1, the second weight plate 7 of the dumbbell 1 comprises an outer face (not shown) which provides a first fastening mechanism of a fourth fastening device similar to the first fastening mechanism 21 of the outer face 19 of the first fixed weight plate 15. The first fastening mechanism of the outer face of the second weight plate 7 comprises an annular groove, a plurality of circular cavities, a plurality of curved guides and a notch, as described with reference to the first fastening mechanism 21 of the outer face 19 of the first fixed weight plate 15.

Referring to FIG. 1, the fourth weight plate 11 comprises an inner face which provides a second fastening mechanism of the fourth fastening device similar to the second fastening mechanism 79 of the inner face 77 of the third weight plate 9. The second fastening mechanism of the inner face of the fourth weight plate 11 comprises an annular ridge, a plurality of circular cavities, a plurality of rollers and a flexible clip, as described with reference to the second fastening mechanism 79 of the inner face 77 of the third weight plate 9.

The second fastening mechanism of the inner face of the fourth weight plate 11 attaches to the first fastening mechanism of the outer face of the second weight plate 7 by aligning the annular ridge and the circular cavities and rollers of the second fastening mechanism of the fourth weight plate 11 with the annular groove and circular cavities of the first fastening mechanism of the second weight plate 7, inserting the annular ridge and the rollers into the annular groove and circular cavities, and rotating the fourth weight plate 11 to move the rollers along the guides of the first fastening mechanism of the second weight plate 7 and to locate the protrusion of the clip of the second fastening mechanism of the fourth weight plate 11 in the notch of the first fastening mechanism of the second weight plate 7.

The second fastening mechanism of the fourth weight plate 11 detaches from the first fastening mechanism of the outer face of the second weight plate 7 by axially flexing the second portion of the flexible clip of the second fastening mechanism of the fourth weight plate 11 to retract the protrusion of the clip from the notch of the first fastening mechanism of the second weight plate 7, rotating the fourth weight plate 11 to move the rollers of the second fastening mechanism of the fourth weight plate 11 back along the guides of the first fastening mechanism of the second weight plate 7 and removing the annular ridge and the rollers from the annular groove and circular cavities of the first fastening mechanism of the outer face of the second weight plate 7.

Referring to FIG. 1, the fourth weight plate 11 of the dumbbell 1 comprises an outer face (not shown) which provides a first fastening mechanism of a fastening device similar to the first fastening mechanism 21 of the outer face 19 of the first fixed weight plate 15. The fastening mechanism of the outer face of the fourth weight plate 11 comprises an annular groove, a plurality of circular cavities, a plurality of curved guides and a notch, as described with reference to the first fastening mechanism 21 of the outer face 19 of the first fixed weight plate 15. The first fastening mechanism of the outer face of the fourth weight plate 11 may be attached to a second fastening mechanism of a fastening device of an inner face of a sixth weight plate or to a second fastening mechanism of a fastening device of an inner face of a cover plate.

The second embodiment of dumbbell is shown in FIGS. 5 to 8 of the drawings and is very similar to the first embodiment. Like parts are given like numbers. The dimensions of the elements are different and different combinations of size and weight of the dumbbell plates provide different effects for the user in exercise routines.

Although, both embodiments shown are in respect of dumbbells which are circular in cross section, other shaped dumbbells can also be used such as hexagonal, triangular, square or other shapes in cross-section.

As the dumbbell 1 can comprise the base unit and one or more sets of weight plates, the weight of the dumbbell can be adapted for individual use. The dumbbell provides a multifunctional and variable weight dumbbell system which can be conveniently stored.

Although the invention has been described with reference to fastening devices of a dumbbell, it will be appreciated that the fastening device can be used with other sports equipment comprising weight plates, such as weightlifting bars.

It is to be understood that the invention is not limited to the specific details described herein which are given by way of example only and that various modifications and alterations are possible without departing from the scope of the invention as defined in the appended claims.

The invention claimed is:

1. A fastening device for sports equipment comprising:

a first weight plate having a first outer edge, a first face, and a first fastening mechanism provided on the first face, wherein the first fastening mechanism includes an annular groove formed in the first face, the annular groove having a radial first inner wall and a radial first outer wall depending inwardly from and axially aligned with the first face of the first weight plate, a first plurality of circular cavities located along the first annular groove, wherein each of the plurality of circular cavities has a first diameter and is formed by a radial inward extension of the first inner wall and a radial outward extension of the first outer wall of the annular groove, wherein the first plurality of circular cavities are substantially evenly-spaced around the annular groove, a plurality of curved guides formed by radial recesses within the first inner wall and the first outer wall of the annular groove, each of the plurality of curved guides starting at a one of the first plurality of circular cavities and extending an equal length along the annular groove in a first direction, wherein each of the plurality of curved guides has a width substantially equal to the first diameter of the first plurality of circular cavities, a notch formed by walls extending radially from the first outer edge of the first weight plate to the annular groove and located at a circumferential notch position, a second weight plate having a second outer edge, a second face and a second fastening mechanism provided on the second face, wherein the second fastening mechanism includes an annular ridge formed by a radial second inner wall and a radial second outer wall depending outwardly from, and axially aligned with, the second face of the second weight plate, a second plurality of circular cavities formed by a radial inward extension of the second inner wall and a radial outward extension of the second outer wall of the annular ridge, wherein each of the second plurality of circular cavities is located at a plurality of substantially evenly-spaced locations around the annular ridge, a plurality of rollers each located within one of the second plurality of circular cavities, and a flexible clip located in a recess provided in the second weight plate at a circumferential clip position offset from the circumferential notch position by the equal length, the clip having a first portion received and attached within a first recess part in the second face of the second weight plate extending radially from the second outer edge of the second weight plate through the annular ridge and having a protrusion extending radially from the second outer edge of the second weight plate towards the annular ridge and a second portion received within a second recess part extending axially from the second outer edge and across a side wall of the second weight plate, wherein the second portion can be flexed to axially retract the protrusion.

2. A dumbbell comprising at least one fastening device according to claim 1.

3. A weightlifting bar comprising at least one fastening device according to claim 1.

4. A dumbbell assembly comprising:

a base unit having a handle with first and second ends;

first and second fixed weight plates fixedly attached to the first and second ends of the handle, wherein each of the first and second fixed weight plates has:

a first outer edge and an outer face located away from the handle which provides a first fastening mechanism, an annular groove formed by a radial first inner wall and a radial first outer wall depending inwardly from, and axially aligned, with the outer face, a first plurality of circular cavities formed by a radial inward extension and a radial outward extension of the first inner wall and the first outer wall of the annular groove, the first plurality of circular cavities having a first diameter and being located at a plurality of substantially evenly-spaced locations around the annular groove, a plurality of curved guides formed by radial recesses within the first inner wall and the first outer wall of the annular groove, each of the plurality of curved guides starting at one of the first plurality of circular cavities and extending an equal length along the annular groove in a first direction and having a width substantially equal to the first diameter, and a first notch formed by walls extending radially from the first outer edge to the annular groove and located at a first circumferential notch position; and free weight plates, wherein each of the free weight plates has:

a second outer edge, a side wall and a first inner face which provides a second fastening mechanism, an annular ridge formed by a radial second inner wall and a radial second outer wall depending outwardly from, and axially aligned with, the first inner face, a second plurality of circular cavities formed by a radial inward extension and a radial outward extension of the second inner wall and the second outer wall of the annular ridge, each of the second plurality of circular cavities located at a plurality of substantially evenly-spaced locations around the annular ridge, a plurality of rollers each located within one of the second plurality of circular cavities and having a width less than the first diameter, and a flexible clip located in a recess provided at a circumferential clip position offset from the first circumferential notch position by the equal length, the clip having a first portion received and attached within a first recess part in the first inner face extending radially from the second outer edge through the annular ridge and having a protrusion extending radially from the second outer edge towards the annular ridge and a second portion received within a second recess part extending axially from the second outer edge and across the side wall, wherein the second portion can be flexed to axially retract the protrusion.

5. The dumbbell assembly according to claim 4 in which the second fastening mechanism on one of the free weight plates attaches to the first fastening mechanism on one of the fixed weight plates by aligning the annular ridge and the second plurality of circular cavities and rollers of the second fastening mechanism with the annular groove and the first plurality of circular cavities of the first fastening mechanism, inserting the annular ridge and the rollers into the annular groove, and rotating said free weight plates to move the rollers along the guides of the first fastening mechanism and to locate the protrusion of the clip of the second fastening mechanism of said free weight plates in the first notch of the first fastening mechanism of said fixed weight plates.

6. The dumbbell assembly according to claim 4 in which the second fastening mechanism on one of the free weight plates detaches from the first fastening mechanism on one of the fixed weight plates by axially moving the second portion of the flexible clip of the second fastening mechanism of said free weight plates to release the protrusion of the clip from the first notch of the first fastening mechanism of said fixed weight plates, rotating said fixed weight plates to move the rollers of the second fastening mechanism back along the guides of the first fastening mechanism and removing the annular ridge and the rollers from the annular groove.

7. The dumbbell assembly according to claim 4 in which the free weight plates each comprises a second outer face which provides a third fastening mechanism having:

a second annular groove formed by a radial third inner wall and a radial third outer wall depending inwardly from, and axially aligned with, the second outer face, a third plurality of circular cavities formed in the third inner wall and the third outer wall of the second annular groove, the third plurality of circular cavities located at substantially evenly-spaced locations around the second annular groove, a second plurality of curved guides formed by radial recesses within the third inner wall and the third outer wall of the second annular groove, each of the second plurality of curved guides starting at one of said third plurality of cavities and extending an equal second length along the second annular groove in a first direction and having a second width substantially equal to that of the third plurality of circular cavities, and a second notch located at a second circumferential notch position.

8. The dumbbell assembly according to claim 7 comprising a second set of free weight plates, each having a second inner face which provides a fourth fastening mechanism that includes:

a second annular ridge formed by a radial fourth inner wall and a radial fourth outer wall depending outwardly from, and axially aligned with, the second inner face, a fourth plurality of circular cavities formed in the fourth inner wall and the fourth outer wall of the second annular ridge, each located at evenly-spaced locations around the second annular ridge, a second plurality of rollers located within the fourth plurality of circular cavities, and a second flexible clip located at a second circumferential clip position offset from the second circumferential notch position by the equal second length.

9. The dumbbell assembly according to claim 8 in which the fourth fastening mechanism of one free weight plate of the second set of free weight plates attaches to the third fastening mechanism of one of the free weight plates by aligning a second annular ridge of the fourth fastening mechanism with the second annular groove of the third fastening mechanism.

10. The dumbbell assembly according to claim 8 in which the fourth fastening mechanism detaches from the third fastening mechanism by axially moving rotating the the second set of free weight plates along the second plurality of curved guides.

11. The dumbbell assembly according to claim 8 in which the second set of free weight plates each comprises a specified weight of 1 kg, 2 kg, 3 kg or 4 kg.

12. The dumbbell assembly according to claim 4 in which the fixed weight plates are fixedly attached to first and second ends of the handle of the base unit by a shrinkage fit process.

13. The dumbbell assembly according to claim 4 in which the fixed weight plates are fixedly attached to the handle of the base unit such that the circumferential notch position of each of the fixed weight plates are substantially circumferentially aligned.

14. The dumbbell assembly according to claim 4 further including first and second cover plates.

15. The dumbbell assembly according to claim 14 in which the first and second cover plates each comprises a specified weight of 1 kg, 2 kg, 3 kg or 4 kg.

16. The dumbbell assembly according to claim 4, in which the base unit comprises a specified weight of 1 kg or 2 kg.

17. The dumbbell assembly according to claim 4 in which the free weight plates each comprises a specified weight of 1 kg, 2 kg, 3 kg or 4 kg.

18. The dumbbell assembly according to claim 4, in which the free weight plates have a shape in cross-section that is circular, hexagonal, triangular, square or any other geometric shape.

* * * * *